US009827576B2

(12) United States Patent
Liao

(10) Patent No.: US 9,827,576 B2
(45) Date of Patent: Nov. 28, 2017

(54) NOZZLE ASSEMBLY CAPABLE OF PERFORMING SUCTION AND HIGH PRESSURE BLOWING

(71) Applicant: Ben-Why Liao, Taichung (TW)

(72) Inventor: Ben-Why Liao, Taichung (TW)

(73) Assignee: Ben-Why Liao, Taichung (TW)

( * ) Notice: Subject to any disclaimer, the term of this patent is extended or adjusted under 35 U.S.C. 154(b) by 52 days.

(21) Appl. No.: 14/594,441

(22) Filed: Jan. 12, 2015

(65) Prior Publication Data

US 2016/0199855 A1 Jul. 14, 2016

(51) Int. Cl.

*B05B 1/12* (2006.01)
*B05B 1/00* (2006.01)
*B05B 7/04* (2006.01)

(52) U.S. Cl.

CPC ..... *B05B 1/005* (2013.01); *B05B 7/0433* (2013.01)

(58) Field of Classification Search

CPC .... B05B 1/16; B05B 1/12; B05B 1/14; B05B 1/3086; B05B 1/323; B05B 7/0425; E03C 1/084

USPC ..... 239/391, 428.5, 514, 515, 505, 419.5, 239/438, 453, 456, 537

See application file for complete search history.

(56) References Cited

U.S. PATENT DOCUMENTS 2,527,848 A * 10/1950 Prack ..... E03C 1/046 239/318
2,761,516 A * 9/1956 Vassilkovsky ..... A62C 5/002 169/15
2,908,227 A * 10/1959 McDougall ..... B05B 7/0408 137/889
2,965,309 A * 12/1960 Parrott ..... A01C 23/042 239/310
3,057,561 A * 10/1962 Corlett, Jr. ..... B05B 1/18 239/524
3,094,171 A * 6/1963 Gagliardo ..... A62C 31/005 169/15
3,194,254 A * 7/1965 Zmek ..... B01F 5/0495 137/114
4,277,030 A * 7/1981 Hechler, IV ..... B05B 1/16 137/889

* cited by examiner

*Primary Examiner* — Chee-Chong Lee
(74) *Attorney, Agent, or Firm* — Yuwen Guo

(57) ABSTRACT

A nozzle assembly comprises an intake section, an inner ring section, a discharging section, an intake screw rod, and two blocking caps. The intake section, the inner ring section and the discharging section are joined to each other to be turned with respect to the intake screw rod and secured to the first position to admit large air flow passing through, and to the second position 180 degrees apart from the first position to perform suction with discharge. One of the blocking caps covers the flow hole of the intake section and another blocking cap covers the discharge bore of the discharging section and is provided with a spray pipe to perform high pressure blowing.

1 Claim, 5 Drawing Sheets

NOZZLE ASSEMBLY CAPABLE OF PERFORMING SUCTION AND HIGH PRESSURE BLOWING

BACKGROUND OF THE INVENTION

1. Field of the Invention

The present invention relates to a nozzle assembly, and more particularly to a nozzle assembly capable of performing suction and high pressure blowing.

2. Description of Related Art

It is known that the traditional air pressure spray gun usually provides the only function of high pressure blowing. The spray gun has a gun body, a handle, and a spray pipe; the spray pipe is disposed at the front end of the gun body, and the rear end of the gun body connects with an air pressure pipe which is further connected to an air compressor; the handle can be gripped or released to control air flow spraying. In order to enhance the function of the spray gun, a large air flow nozzle at the front end of the spray pipe has been developed in recent years to produce large air flow so as to promote functions provided by the spray gun.

In order to allow the traditional spray gun to spray large air flow, the air flow output end of the spray pipe is provided with a spray head, and the spray head has an air aperture at the end joining the spray pipe and is disposed behind the air flow output end of the spray pipe. When the air flow sprays out of the spray pipe, there is negative pressure inside the spray head to accelerate air outside the spray head to enter the spray head and force the air flow to spray outward via the spray pipe such that a large air flow can be produced by the spray gun.

SUMMARY OF THE INVENTION

In order to enhance the function of the preceding said traditional spray gun. an object of the present invention provides a nozzle assembly with which fluid operating device such as the spray gun is capable of sucking fluid flow out in addition to output the fluid flow without changing the way the fluid operating device is accustomed to use.

Another object of the present invention is to provide a nozzle assembly which is easily and simply set up and operated, and is compatible with the conventional fluid operating device.

A further object of the present invention is to provide a nozzle assembly which is capable of being employed in association with any device dealing with fluid such that works such as cooling, cleaning and sucking for machines and various devices can be performed conveniently.

BRIEF DESCRIPTION OF THE DRAWINGS

Further benefits and advantages of the present invention will become apparent after a careful reading of the detailed description with appropriate reference to the accompanying drawings:

FIG. 1 is a sectional view of a preferred embodiment of a nozzle assembly according the present invention to illustrate a large air flow passing through.

FIG. 4 is a sectional view of another preferred embodiment of a nozzle assembly according to the present invention to illustrate a large air flow passing through.

FIG. 5 is a sectional view of an embodiment of the present invention in which a spray gun with a spray pipe attached with a spray head to illustrate a large air flow passing through.

DETAILED DESCRIPTION OF THE INVENTION

Figure 1:
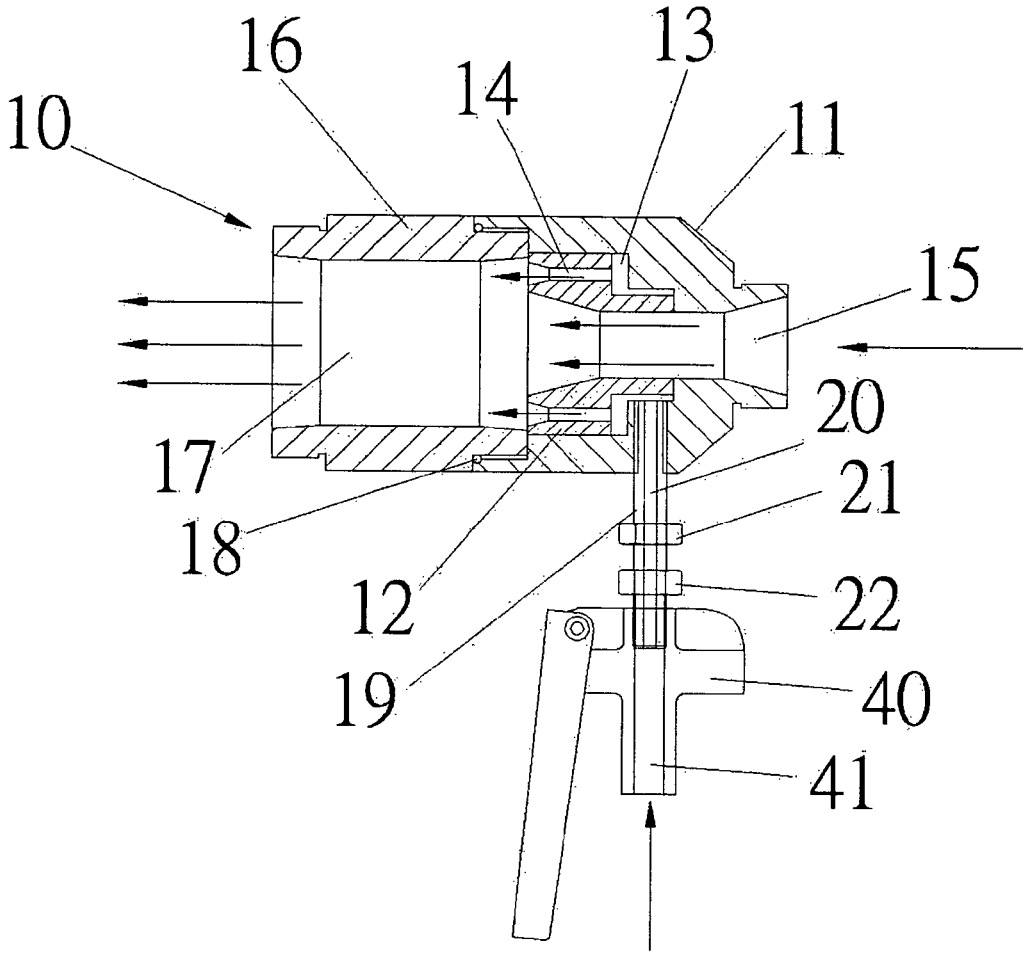

Referring to FIG. 1, a preferred embodiment of a nozzle assembly according the present invention showing large flow passing through is illustrated. The nozzle assembly of the preferred embodiment basically is a nozzle assembly 10 which comprises an intake section 11, an inner ring section 12, and a discharging section 16; a chamber 13 is formed between the intake section 11 and the inner ring section 12; the centers of the intake section 11 and the inner ring section 12 form a flow hole 15, and the discharging section 16 has a discharge bore 17 to communicate with the flow hole 15. Further, the inner ring section 12 has an annular outlet 14 to communicate the chamber 13 and the discharge bore 17, and an O-ring 18 is disposed between the intake section 11 and the discharging section 16. In addition, an intake screw rod 19 is movably joined to and extends downward from the intake section 11 to connect with a passage 41 of a fluid operating device 40 such as an air gun such that the nozzle assembly 10 can perform functions such as suction and blowing for a cleaning job.

Fluid from the fluid operating device 40 enters the chamber 13 via the passage 41 and moves toward the discharge bore 17 via the annular outlet 14; due to the annular outlet 14 having an enlarged output end to accelerate the fluid flow in the flow hole 15 outward the nozzle assembly 10 via the discharge bore 17; in the meantime, the fluid inside the flow hole 15 is negative pressure; both ends of the flow hole 15 are enlarged to accelerate the fluid flowing in and out, and the middle portion of the flow hole 15 has a reduced size such that the high pressure fluid flow in the chamber 13 is capable of spraying outward the annular outlet 14. As a result, the discharge bore 17 in the discharging section 16 discharges a large amount of fluid flow outward the nozzle assembly 10. Furthermore, an adjustable nut 21 and an engaging nut 22 are disposed on the intake screw rod 19 to secure the intake screw rod 19. the intake section 11 and the fluid operating device 40 together.

Besides, the fluid operating device 40 can be any device other than the air gun shown in FIG. 1, and, that is, the intake screw rod 19 of the nozzle assembly 10 is arranged to be compatible with any fluid operating device 40 such that the fluid from the fluid operating device 40 can enter the intake section 11 via the intake screw rod 19 to attain predetermined function effectively.

Figure 2:
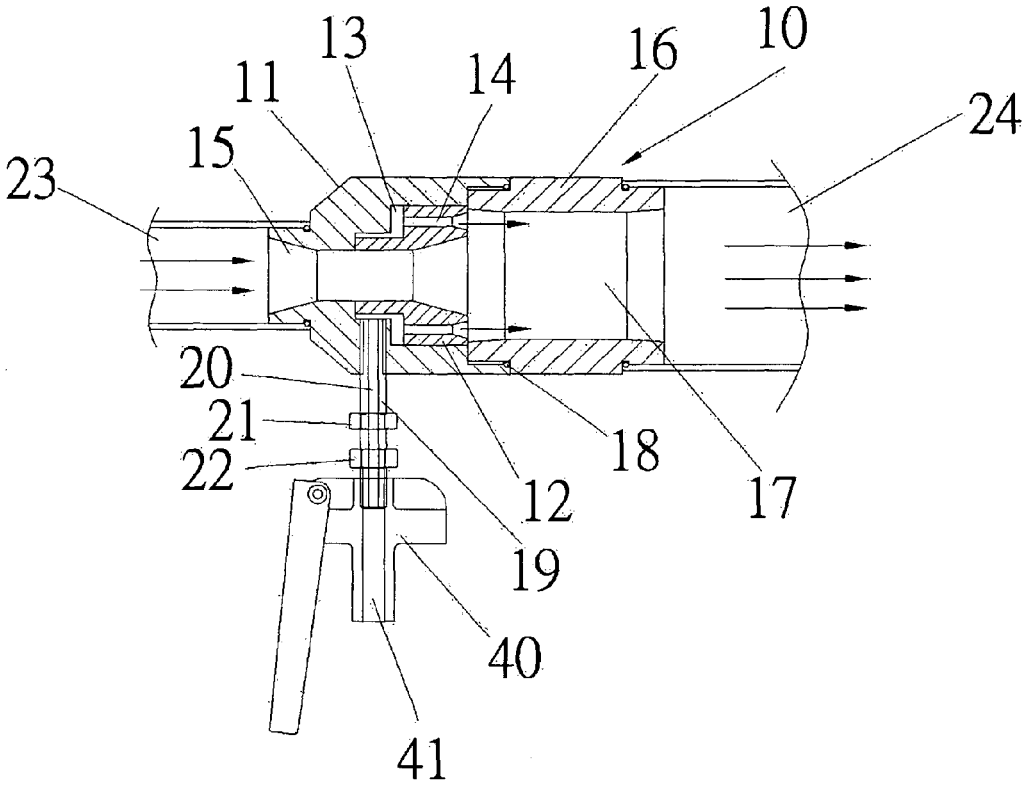
FIG. 2 is a sectional view of the first embodiment of the nozzle assembly according to the present invention to illustrate that the nozzle assembly is turned to a position 180 degrees apart from the position shown in FIG. 1 to perform suction.

Referring to FIG. 2, the suction performed by the first embodiment of the nozzle assembly 10 is illustrated. The intake section 11, the inner ring section 12.

and the discharging section 16 of the nozzle assembly 10 are joined with each other as a unit which is capable of being turned with respect to the intake screw rod 19. Hence, when the engaging nut 22 is loosened, and the intake section 11 with the inner ring section 12 and the discharging section 16 is rotated to a position which is 180 degrees apart from the position shown in FIG. 1 before the engaging nut 22 is fastened tightly to the fluid operating device 40. Under the circumstances, the positions of the flow hole 15 and the discharge bore 17 are exchanged to each other with a suction pipe 23 fitted to the flow hole 15 and a discharge pipe 24 fitted to the discharge bore 17. A distal end of the discharge pipe 24 is disposed in a barrel, and the suction pipe 23 is disposed against a sucked object such as lubrication oil, polluted water, or the waste such that the object can be sucked into the barrel via the flow hole 15, the discharge bore 17 and the discharge pipe 24 to perform suction with discharge.

Figure 3:
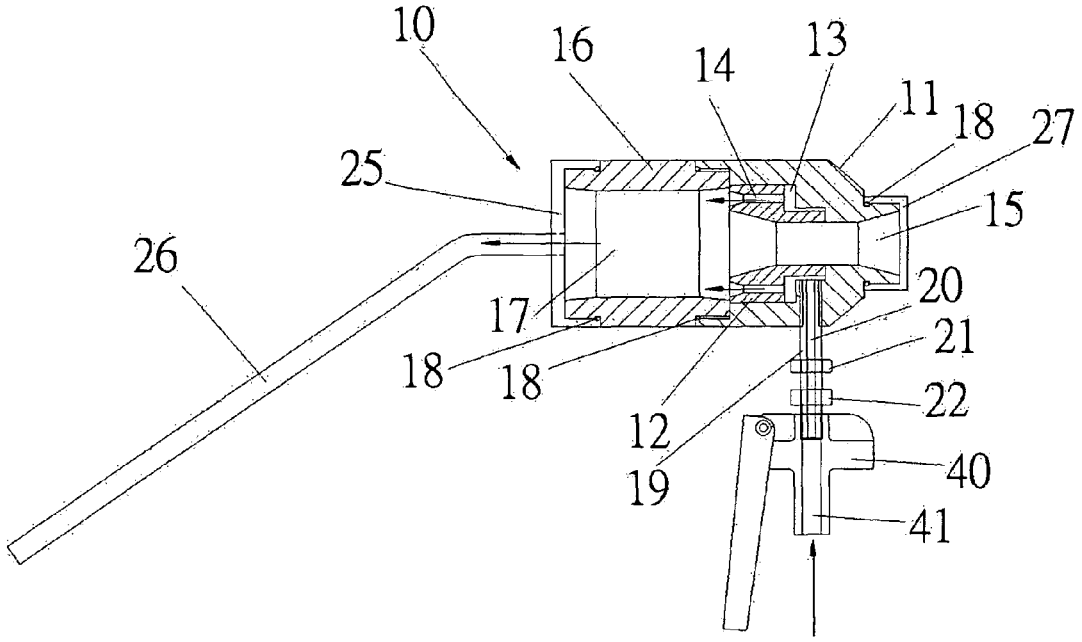
FIG. 3 is a sectional view of the first embodiment of the nozzle assembly according to the present invention showing high pressure blowing.

Referring to FIG. 3, the high pressure blowing performed in the first embodiment of the nozzle is illustrated. A blocking cap 27 is disposed to cover the flow hole 15 of intake section 11 with an O-ring 18 being tightly disposed between the cap 27 and the intake section 11. Another blocking cap 25 is disposed to cover the discharge bore 17 of the discharging section 16 with another O-ring 18 disposed tightly between the cap 25 and the discharging section 16 as well. Further, the cap 25 is provided with a spray pipe 26.

The air outside the nozzle assembly 10 is blocked by the cap 27 such that compressed air from the passage 41 of the fluid operating device 40 flows through an air passage 20 of the intake screw rod 19, the chamber 13, the annular outlet 14, and the discharge bore 17 to enter the spray pipe 26 to perform the high pressure blowing.

Figure 4:
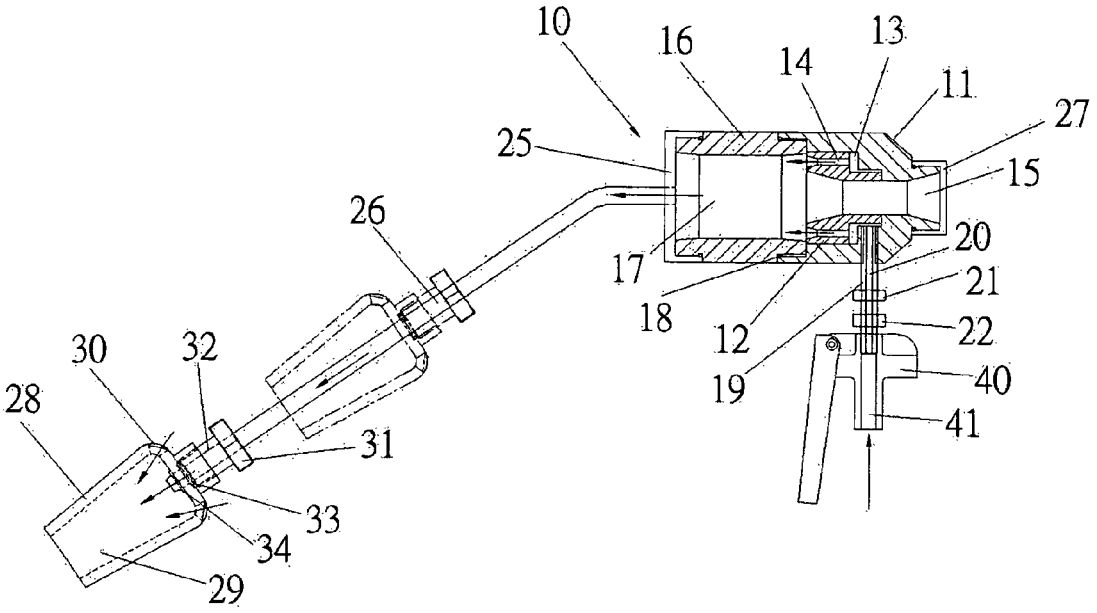

Referring to FIG. 4, another preferred embodiment of a nozzle assembly according to the present invention is illustrated. The difference of the present preferred embodiment from the first embodiment is in that a spray head 28 is slidably attached to the spray pipe 26. A sliding screw 31 is joined to the rear end of the spray head 28; a sliding hole 32 is disposed in the sliding screw 31 axially with the inner wall surface thereof slidably contacting the outer surface of the spray pipe 26 such that the sliding screw 31 is capable of sliding along the spray pipe 26. An O-ring 34 is disposed between the spray head 28 and the sliding screw 31 to be pressed and deformed at the time of the sliding screw 31 engaging with spray head 28 such that the inner diameter of the O-ring 34 and the outer diameter of the spray pipe 26 contact with each other tightly and the spray head 28 is secured without sliding when the position of the spray head 28 on the spray pipe 26 is determined. That is, the position of the spray head 28 can be adjusted to allow the exit end of the spray pipe 26 being in the spray head 28 or outside the spray head 28 so as to change the state of spray of the fluid flow, i.e., the state of large flow output or high pressure blowing. Further, the spray head 28 has a spray chamber 29 with an outlet end and an inlet end, and the inlet end is provided with a plurality of openings 30. There is a distance between the exit end of the spray pipe 26 and the outlet end of the spray head 28 during the exit end of the spray pipe 26 is in the spray head 28. When the spray head 28 is moved, the distance changes to control quantity of the fluid flow outward the spray head 28.

When the high pressure air flowing from the spray pipe 26 sprays outward via the spray chamber 29 of the spray head 28, the spray chamber 29 becomes in a state of negative pressure to suck the air behind the air openings 30 of the spray head 28. Besides, each of the openings 30 is convergent shaped to accelerate the air entering the spray head 28 in addition to high velocity air flow from the spray pipe 26 such that there is a large quantity of air flow in the spray chamber 29 to spray outward.

Furthermore, a flange 34 is provided at the exit end of the spray pipe 26 to prevent the spray head 28 from detaching from and falling off the spray pipe 26.

Figure 5:
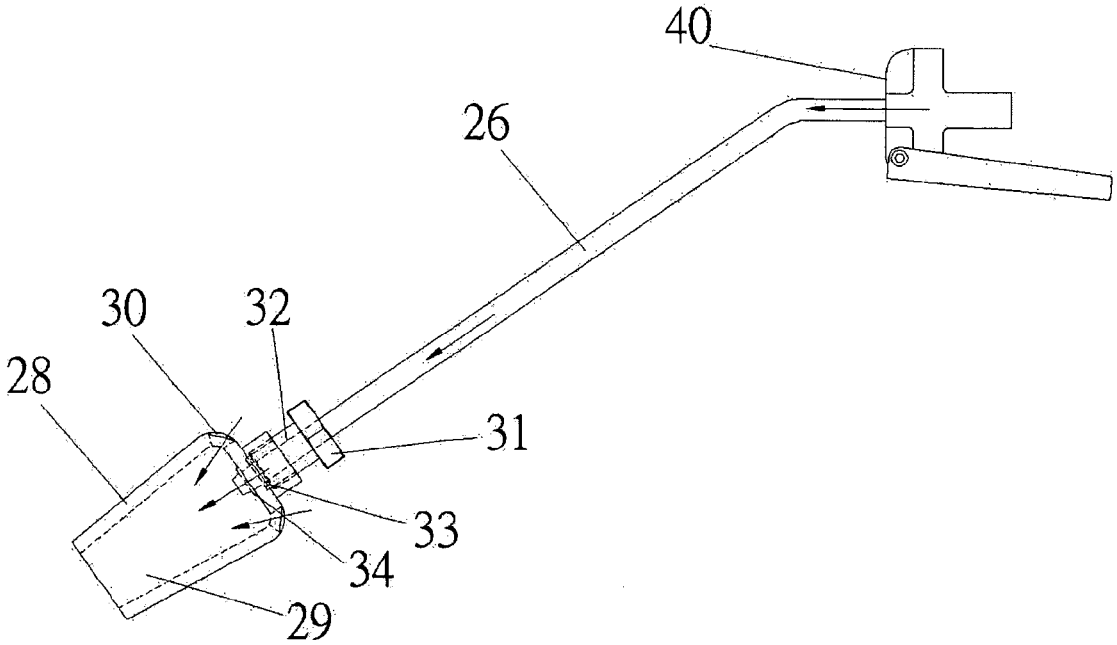

Referring to FIG. 5, a further preferred embodiment of the present invention is illustrated. The spray pipe 26 is employed to connect with the air gun 40 directly. Hence, due to the spray head 28 capable of moving on the spray pipe 26, the air gun 40 can work for high pressure blowing or large air flow spraying as well.

It is noted that the nozzle assembly of the present invention can be employed to join with any fluid operating device except the air gun for works such as cooling, cleaning and sucking being performed conveniently for machines and various apparatus.

Although the invention has been explained in relation to the embodiments, it is to be understood that other possible modifications and variations can be made without departing from the spirit and scope of the invention as hereinafter claimed.

What is claimed is:

1. A nozzle assembly comprising a sliding spray head slidably disposed on a spray pipe so as to change a state of spray of a fluid flow by sliding the spray head along the spray pipe, wherein the sliding spray head has a spray chamber with an outlet end and an inlet end, and the inlet end has a plurality of openings, a sliding screw is joined to the rear end of the spray head, a sliding hole is disposed in the sliding screw axially with an inner wall surface thereof slidably contacting an outer surface of the spray pipe such that the sliding screw slides along the spray pipe, and an O-ring is disposed between the spray head and the sliding screw to be pressed and deformed at time of the sliding screw engaging with the spray head such that an inner diameter of the O-ring and an outer diameter of the spray pipe contact with each other tightly so that the spray head is secured without sliding when a position of the spray head on the spray pipe is determined.

* * * * *